US006709695B2

(12) United States Patent
Takeishi et al.

(10) Patent No.: US 6,709,695 B2
(45) **Date of Patent: *Mar. 23, 2004**

(54) COMPOSITE SUBSTRATE, METHOD OF MAKING, AND EL DEVICE USING THE SAME

(75) Inventors: Taku Takeishi, Chuo-ku (JP); Katsuto Nagano, Chuo-ku (JP); Suguru Takayama, Chuo-ku (JP)

(73) Assignee: TDK Corporation, Tokyo (JP)

( * ) Notice: Subject to any disclaimer, the term of this patent is extended or adjusted under 35 U.S.C. 154(b) by 166 days.

This patent is subject to a terminal disclaimer.

(21) Appl. No.: 09/970,803

(22) Filed: Oct. 5, 2001

(65) Prior Publication Data

US 2002/0043930 A1 Apr. 18, 2002

Related U.S. Application Data

(63) Continuation of application No. PCT/JP01/00815, filed on Feb. 6, 2001.

(30) Foreign Application Priority Data

Feb. 7, 2000 (JP) ..... 2000-029465
Mar. 3, 2000 (JP) ..... 2000-059521
Mar. 3, 2000 (JP) ..... 2000-059522

(51) Int. Cl.[7] ..... B05D 5/12

(52) U.S. Cl. ..... 427/66; 427/74; 427/77; 427/359; 427/361

(58) Field of Search ..... 427/66, 74, 77, 427/359, 366

(56) References Cited

U.S. PATENT DOCUMENTS 5,830,028 A * 11/1998 Zovko et al. ..... 446/15

FOREIGN PATENT DOCUMENTS

| | | | |
|---|---|---|---|
| JP | 61-230294 | | 10/1986 |
| JP | 61-230296 | | 10/1986 |
| JP | 281295 | * | 12/1987 |
| JP | 62-278791 | | 12/1987 |
| JP | 62-278792 | | 12/1987 |
| JP | 62-281295 | | 12/1987 |
| JP | 63-69193 | | 3/1988 |
| JP | 64-63297 | | 3/1989 |
| JP | 199790 | * | 8/1990 |
| JP | 02-199790 | | 8/1990 |
| JP | 277492 | * | 2/1992 |
| JP | 04-277492 | | 2/1992 |
| JP | 283265 | * | 10/1994 |
| JP | 07-050197 | | 2/1995 |

* cited by examiner

*Primary Examiner*—Brian K. Talbot
(74) *Attorney, Agent, or Firm*—Oblon, Spivak, McClelland, Maier & Neustadt, P.C.

(57) ABSTRACT

The invention aims to provide a method for preparing a composite substrate, which prevents an insulating layer surface from becoming rugged under the influence of an electrode layer, and eliminates a polishing step, whereby the composite substrate is easy to manufacture and ensures high display quality when applied to thin-film light emitting devices, the composite substrate and an thin-film EL device using the same. The object is attained by a method for preparing a composite substrate by successively applying an electrode paste and an insulator paste onto an electrically insulating substrate as thick films to form a composite substrate precursor having a green electrode layer and a green insulator layer laminated, subjecting the precursor to pressing treatment for smoothing its surface, and firing; the composite substrate and an EL device using the same.

4 Claims, 1 Drawing Sheet

COMPOSITE SUBSTRATE, METHOD OF MAKING, AND EL DEVICE USING THE SAME

CROSS-REFERENCE TO RELATED APPLICATION

This application claims priority to International Application No. PCT/JP01/00815 filed Feb. 6, 2001 and Japanese Application Nos. 2000-029465 filed Feb. 7, 2000, 2000-059521 filed Mar. 3, 2000 and 2000-059522 filed Mar. 3, 2000, and the entire content of both applications is hereby incorporated by reference.

TECHNICAL FIELD

This invention relates to a composite substrate having a dielectric and an electrode, an electroluminescent (EL) device using the same, and a method for preparing the same.

BACKGROUND ART

The phenomenon that a material emits light upon application of an electric field is known as electroluminescence (EL). Devices utilizing this phenomenon are on commercial use as backlight in liquid crystal displays (LCD) and watches.

The EL devices include dispersion type devices of the structure that a dispersion of a powder phosphor in an organic material or enamel is sandwiched between electrodes, and thin-film type devices in which a thin-film phosphor sandwiched between two electrodes and two insulating thin films is formed on an electrically insulating substrate. For each type, the drive modes include DC voltage drive mode and AC voltage drive mode. The dispersion type EL devices are known from the past and have the advantage of easy manufacture, but their use is limited because of a low luminance and a short lifetime. On the other hand, the thin-film type EL devices have markedly spread the practical range of EL device application by virtue of a high luminance and a long lifetime.

In prior art thin-film type EL devices, the predominant structure is such that blue sheet glass customarily used in liquid crystal displays and plasma display panels (PDP) is employed as the substrate, a transparent electrode of ITO or the like is used as the electrode in contact with the substrate, and the phosphor emits light which exits from the substrate side. Among phosphor materials, Mn-doped ZnS which emits yellowish orange light has been often used from the standpoints of ease of deposition and light emitting characteristics. The use of phosphor materials which emit light in the primaries of red, green and blue is essential to manufacture color displays. Engineers continued research on candidate phosphor materials such as Ce-doped SrS and Tm-doped ZnS for blue light emission, Sm-doped ZnS and Eu-doped CaS for red light emission, and Tb-doped ZnS and Ce-doped CaS for green light emission. However, problems of emission luminance, luminous efficiency and color purity remain outstanding until now, and none of these materials have reached the practical level.

High-temperature film deposition and high-temperature heat treatment following deposition are known to be promising as means for solving these problems. When such a process is employed, use of blue sheet glass as the substrate is unacceptable from the standpoint of heat resistance. Quartz substrates having heat resistance are under consideration, but they are not adequate in such applications requiring a large surface area as in displays because the quartz substrates are very expensive.

It was recently reported that a device was developed using an electrically insulating ceramic substrate as the substrate and a thick-film dielectric instead of a thin-film film insulator under the phosphor, as disclosed in JP-A 7-50197 and JP-B 7-44072.

FIG. 2 illustrates the basic structure of this device. The EL device in FIG. 2 is structured such that a lower electrode 12, a thick-film dielectric layer 13, a light emitting layer 14, a thin-film insulating layer 15 and an upper electrode 16 are successively formed on a substrate 11 of ceramic or similar material. Since the light emitted by the phosphor exits from the upper side of the EL structure opposite to the substrate as opposed to the prior art structure, the upper electrode is a transparent electrode.

In this device, the thick-film dielectric has a thickness of several tens of microns which is about several hundred to several thousand times the thickness of the thin-film insulator. This offers advantages including a minimized chance of breakdown caused by pinholes or the like, high reliability, and high manufacturing yields.

Use of the thick dielectric invites a drop of the voltage applied to the phosphor layer, which is overcome by using a high-permittivity material as the dielectric layer. Use of the ceramic substrate and the thick-film dielectric permits a higher temperature for heat treatment. As a result, it becomes possible to deposit a light emitting material having good luminescent characteristics, which was impossible in the prior art because of the presence of crystal defects.

However, the light emitting layer formed on the thick-film dielectric layer has a thickness of several hundreds of nanometers which is about one hundredth of the thickness of the thick-film dielectric layer. This requires the surface of the thick-film dielectric layer to be smooth at a level below the thickness of the light emitting layer. However, a conventional thick-film technique was difficult to form a dielectric layer having a fully flat and smooth surface.

If the surface of the dielectric layer is not flat or smooth, there is a risk that a light emitting layer cannot be evenly formed thereon or a delamination phenomenon can occur between the light emitting layer and the dielectric layer, substantially detracting from display quality. Therefore, the prior art method needed the steps of removing large asperities as by polishing and removing small asperities by a sol-gel process.

However, it is technically difficult to polish large surface area composite substrates for display and other applications. The sol-gel process cannot accommodate for large asperities when used alone. Additionally, an increased cost of stock material and an increased number of steps involved are undesirable.

SUMMARY OF THE INVENTION

An object of the invention is to provide a method for preparing a composite substrate, which prevents an insulating layer surface from becoming rugged under the influence of an electrode layer, and eliminates a polishing step, whereby the composite substrate is easy to manufacture and ensures high display quality when applied to thin-film light emitting devices, the composite substrate and an EL device using the same.

The above object is attained by the following construction.

(1) A method for preparing a composite substrate, comprising the steps of:

successively applying an electrode paste and an insulator paste onto an electrically insulating substrate as thick films to form a composite substrate precursor having a green electrode layer and a green insulator layer laminated, subjecting the precursor to pressing treatment using a die press or roll, for smoothing its surface, and firing to complete the composite substrate.

(2) The method for preparing a composite substrate according to (1), wherein during the pressing treatment, the die or roll used for pressing is held at a temperature in the range of 50 to 200° C.

(3) The method for preparing a composite substrate according to (1) or (2), wherein the electrode paste and/or the insulator paste uses a thermoplastic resin as a binder.

(4) The method for preparing a composite substrate according to any one of (1) to (3), wherein during the pressing treatment, a resin film having a parting agent thereon is interposed between the die or roll and the green dielectric layer.

(5) A composite substrate obtained by the method of any one of (1) to (4), wherein a functional thin film is to be formed on the thick-film dielectric layer.

(6) An EL device comprising at least a light emitting layer and a transparent electrode on the composite substrate of (5).

(7) The EL device of (6) further comprising a thin-film insulating layer between the light emitting layer and the transparent electrode.

FUNCTION

According to the invention, a composite substrate of substrate/electrode/insulator layer having a thick-film insulator layer with a smooth surface can be prepared by a simple step of carrying out compression on an unfired dielectric layer.

When an EL device is prepared using the composite substrate having an insulator layer with a smooth surface, a light emitting layer to lie thereon can be formed uniformly without giving rise to a delamination phenomenon. As a result, an EL device having improved light-emitting performance and reliability can be fabricated. The compression step is compliant with large surface area displays because of an eliminated need for polishing step which was necessary in the prior art, and reduces the manufacturing cost because of a reduced number of steps.

BEST MODE FOR CARRYING OUT THE INVENTION

In the method for preparing a composite substrate according to the invention, an electrode paste and an insulator paste are successively applied onto an electrically insulating substrate as thick films to form a composite substrate precursor having a green electrode layer and a green insulator layer laminated, and the precursor is subjected to pressing treatment for smoothing its surface, followed by firing to complete the composite substrate.

Figure 1:
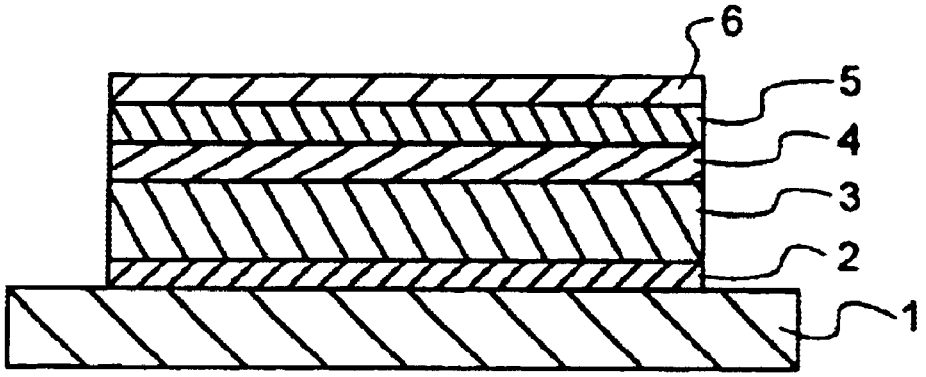
FIG. 1 is a fragmentary cross-sectional view showing the basic construction of an EL device according to the invention.
Figure 2:
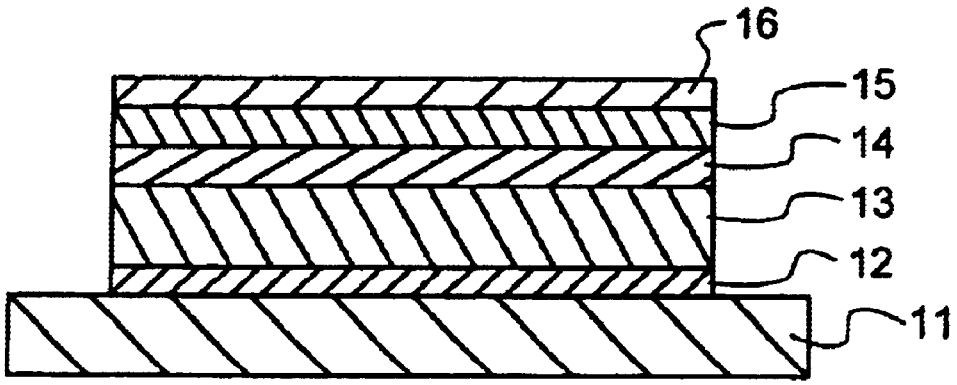
FIG. 2 PRIOR ART
FIG. 2 is a fragmentary cross-sectional view showing the construction of a prior art thin-film EL device.

FIG. 1 illustrates the basic construction of a composite substrate to be prepared by the inventive method and an EL device using the same. The composite substrate to be prepared by the inventive method has a substrate 1, an electrode 2 formed thereon in a predetermined pattern, and an insulator layer 3 formed thereon by a thick-film technique. The EL device using the composite substrate further has a light emitting layer 4 on the insulator layer 3, preferably a thin-film insulating layer 5, and a transparent electrode 6 thereon.

The composite substrate precursor can be prepared by conventional thick film techniques. Specifically, on an electrically insulating ceramic substrate, for example, of $Al_2O_3$ or crystallized glass, an electrode paste prepared by mixing a conductor powder such as Pd or Ag/Pd with a binder and a solvent is printed in a predetermined pattern by a screen printing technique or the like. Then, an insulator paste prepared by mixing a powdery insulating material with a binder and a solvent is similarly printed on the electrode pattern. Alternatively, the insulator paste is cast to form a green sheet, which is laid on the electrode. In a still alternative embodiment, an electrode is printed on a green sheet of insulator, which is laid on the substrate.

The composite substrate precursor thus formed is subjected to pressing treatment to smooth its surface. The pressing means contemplated herein include a method of pressing the composite substrate using a large surface area die, and a method of placing a roll tightly against the thick-film insulator layer of the composite substrate and rotating the roll while moving the composite substrate. The pressure applied is preferably about 10 to 5,000 ton/$m^2$.

Better results are obtained when a thermoplastic resin is used as the binder in preparing the electrode and/or insulator paste, and the pressing die or roll is heated upon pressure application.

In the embodiment wherein the green insulating body is pressed using the die or roll, a resin film having a parting agent applied is preferably interposed between the die or roll and the green insulating body in order to prevent the green insulating body from sticking or bonding to the die or roll.

Examples of the resin film include tetraacetyl cellulose (TAC), polyethylene terephthalate (PET), polyethylene naphthalate (PEN), syndiotactic polystyrene (SPS), polyphenylene sulfide (PPS), polycarbonate (PC), polyarylate (PAr), polysulfone (PSF), polyester sulfone (PES), polyether imide (PEI), cyclic polyolefin, and brominated phenoxy resin, with PET film being especially preferred.

The parting agent may be a silicone material such as a dimethylsilicone base material. The parting agent is usually coated onto the resin film.

When the die or roll is heated, the temperature of the die or roll, which differs depending on the type of binder, especially the melting point, glass transition temperature and other properties thereof, is usually about 50 to 200° C. Too low a heating temperature fails to achieve sufficient smoothing effects. If the heating temperature is too high, the binder can be partly decomposed and the green insulator layer be bonded to the die or roll or the resin film.

The insulator layer of the green composite substrate thus obtained should preferably have a surface roughness Ra of up to 0.1 $\mu$m. A surface roughness of this level can be accomplished by adjusting the surface roughness of the die or simply by interposing a resin film having a smooth surface during pressure application.

Firing is preceded by binder removal which may be performed under well-known conditions. When firing is carried out in a reducing atmosphere, the following conditions are especially preferred.

Heating rate: 5–500° C./hr, especially 10–400° C./hr

Holding temperature: 200–400° C., especially 250–300° C.

Holding time: 0.5–24 hr, especially 5–20 hr

Atmosphere: air

The atmosphere for firing may be determined as appropriate, depending on the type of conductor in the electrode layer-forming paste. When firing is carried out in a reducing atmosphere, the preferred firing atmosphere is a mixture of a substantial proportion of $N_2$, 1 to 10% of $H_2$, and $H_2O$ vapor resulting from the water vapor pressure at 10 to 35° C. The oxygen partial pressure is preferably in the range of $10^{-8}$ to $10^{-12}$ atm. If the oxygen partial pressure is below the range, the conductor in the electrode layer can be abnormally sintered and disconnected. An oxygen partial pressure in excess of the range tends to oxidize the electrode layer. In the event of firing in an oxidizing atmosphere, conventional firing in air may be carried out.

The holding temperature during the firing step may be determined as appropriate, depending on the type of the insulator layer, although it is usually about 800 to 1,400° C. A holding temperature below the range may result in insufficient consolidation whereas a holding temperature above the range may often cause the electrode layer to be disconnected. The temperature holding time during the firing is preferably 0.05 to 8 hours, and especially 0.1 to 3 hours.

When fired in a reducing atmosphere, the composite substrate is preferably annealed if necessary. The annealing serves to oxidize the insulator layer again, thereby considerably prolonging the IR accelerated lifetime.

The annealing atmosphere preferably has an oxygen partial pressure of at least $10^{-6}$ atm., and especially $10^{-6}$ to $10^{-8}$ atm. An oxygen partial pressure below the range may make it difficult to oxidize the insulator layer or dielectric layer again whereas an oxygen partial pressure above the range tends to oxidize the internal conductor.

The holding temperature during the annealing step is preferably up to 1,100° C., and especially 1,000 to 1,100° C. A holding temperature below the range tends to oxidize the insulator layer or dielectric layer to an insufficient extent, resulting in a short lifetime. A holding temperature above the range not only tends to oxidize the electrode layer to reduce the current capacity, but also tends to cause the electrode layer to react with the insulating or dielectric matrix, resulting in a short lifetime.

It is noted that the annealing step may consist solely of heating and cooling steps. In this case, the temperature holding time is zero and the holding temperature is equal to the maximum temperature. The temperature holding time is preferably 0 to 20 hours, and especially 2 to 10 hours. The gas for the atmosphere is preferably humidified $H_2$ gas or the like.

In each of the aforementioned binder removal, firing and annealing steps, $N_2$, $H_2$ or a mixture gas thereof is humidified using a wetter, for example. Water in the wetter is preferably at a temperature of about 5 to 75° C.

The binder removal, firing and annealing steps may be carried out either continuously or separately.

Preferably, the process of carrying out these steps continuously involves, after the binder removal step, changing the atmosphere without cooling, heating to the holding temperature for firing, thereby carrying out the firing step, then cooling, changing the atmosphere when the holding temperature for annealing is reached, and carrying out the annealing step.

In the process of carrying out these steps separately, the binder removal step is carried out by heating to a predetermined holding temperature, holding thereat for a predetermined time, and cooling to room temperature. The atmosphere for binder removal is the same as used in the continuous process. Further, the annealing step is carried out by heating to a predetermined holding temperature, holding thereat for a predetermined time, and cooling to room temperature. The annealing atmosphere is the same as used in the continuous process. In an alternative embodiment, the binder removal step and the firing step are carried out continuously, and only the annealing step is carried out separately. In a further alternative embodiment, only the binder removal step is carried out separately, and the firing step and the annealing step are carried out continuously.

Better results are obtained when the firing is followed by further surface smoothing by a sol-gel process. Surface smoothing may be carried out by conventional sol-gel processes although it is preferred to use a sol-gel solution obtained by dissolving a metal compound in a diol represented by $OH(CH_2)_nOH$, typically propane diol as a solvent. Although metal alkoxides are often used as the metal compound source in the preparation of sol-gel solutions, they are prone to hydrolysis. In preparing a high concentration solution, it is preferred to use acetylacetonato compounds and derivatives thereof in order to prevent the source from precipitating and settling and the solution from solidifying. It is also preferred to use lead-free barium titanate ($BaTiO_3$) as a main component.

The substrate used herein is not critical as long as it is electrically insulating, does not contaminate any overlying layers such as an insulating layer (dielectric layer) and electrode layer, and maintains a desired strength. Illustrative materials are ceramic substrates including alumina ($Al_2O_3$), quartz glass ($SiO_2$), magnesia (MgO), forsterite ($2MgO.SiO_2$), steatite ($MgO.SiO_2$), mullite ($3Al_2O_3.2SiO_2$), beryllia (BeO), zirconia ($ZrO_2$), aluminum nitride (AlN), silicon nitride (SiN), and silicon carbide (SiC+BeO). Additionally, barium, strontium and lead family perovskite compounds are useful, and in this case, a substrate material having the same composition as the insulating layer can be used. Of these, alumina substrates are preferred; and beryllia, aluminum nitride and silicon carbide are preferred when heat conductivity is necessary. Use of a substrate material having the same composition as the thick-film dielectric layer or insulating layer is advantageous because bowing, stripping and other undesired phenomena due to differential thermal expansion do not occur.

The temperature at which these substrates are fired is at least about 800° C., preferably about 800° C. to 1,500° C., and more preferably about 1,200° C. to 1,400° C.

A glass material may be contained in the substrate for the purpose of lowering the firing temperature. Illustrative are PbO, $B_2O_3$, $SiO_2$, CaO, MgO, $TiO_2$, and $ZrO_2$, alone or in admixture of any. The content of glass is about 20 to 30% by weight based on the substrate material.

An organic binder may be used when a paste for forming the substrate is prepared. The organic binder used herein is not critical and a proper choice may be made among binders commonly used for ceramic materials. Examples of the organic binder include ethyl cellulose, acrylic resins and butyral resins, and examples of the solvent include α-terpineol, butyl Carbitol, and kerosene. The contents of organic binder and solvent in the paste are not critical and may be as usual. For example, the content of organic binder is about 1 to 5 wt % and the content of solvent is about 10 to 50 wt %.

In the substrate-forming paste, various additives such as dispersants, plasticizers, and insulators are contained if necessary. The overall content of these additives should preferably be no more than 1 wt %.

The substrate generally has a thickness of about 1 to 5 mm, and preferably about 1 to 3 mm.

A base metal may be used as the electrode material when firing is carried out in a reducing atmosphere. Preferably, use is made of one or more of Mn, Fe, Co, Ni, Cu, Si, W and Mo, as well as Ni—Cu, Ni—Mn, Ni—Cr, Ni—Co and Ni—Al alloys, with Ni, Cu and Ni—Cu alloy being more preferred.

When firing is carried out in an oxidizing atmosphere, a metal which does not form an oxide in an oxidizing atmosphere is preferred. Illustrative examples include one or more of Ag, Au, Pt, Rh, Ru, Ir, Pb and Pd, with Ag, Pd and Ag—Pd alloy being more preferred.

The electrode layer may contain glass frit because its adhesion to the underlying substrate is enhanced. When firing is carried out in a neutral or reducing atmosphere, a glass frit which does not lose glass behavior in such an atmosphere is preferred.

The composition of glass frit is not critical as long as the above requirement is met. For example, there may be used one or more glass frits selected from among silicate glass ($SiO_2$ 20–80 wt %, $Na_2O$ 80–20 wt %), borosilicate glass ($B_2O_3$ 5–50 wt %, $SiO_2$ 5–70 wt %, PbO 1–10 wt %, $K_2O$ 1–15 wt %), and aluminosilicate glass ($Al_2O_3$ 1–30 wt %, $SiO_2$ 10–60 wt %, $Na_2O$ 5–15 wt %, CaO 1–20 wt %, $B_2O_3$ 5–30 wt %). If desired, at least one additive selected from among CaO 0.01–50 wt %, SrO 0.01–70 wt %, BaO 0.01–50 wt %, MgO 0.01–5 wt %, ZnO 0.01–70 wt %, PbO 0.01–5 wt %, $Na_2O$ 0.01–10 wt %, $K_2O$ 0.01–10 wt % and $MnO_2$ 0.01–20 wt % may be admixed with the glass frit so as to give a predetermined compositional ratio. The content of glass relative to the metal component is not critical although it is usually about 0.5 to 20% by weight, and preferably about 1 to 10% by weight. The overall content of the additives in the glass component is preferably no more than 50% by weight provided that the glass component is 100.

An organic binder may be used when a paste for forming the electrode layer is prepared. The organic binder used herein is the same as described for the substrate. Among these, thermoplastic resins, especially acrylic and butyral resins are preferred. In the electrode layer-forming paste, various additives such as dispersants, plasticizers, and insulators are contained if necessary. The overall content of these additives should preferably be no more than 1 wt %.

The electrode layer generally has a thickness of about 0.5 to 5 $\mu$m, and preferably about 1 to 3 $\mu$m.

The insulating material of which the insulator layer is made is not critical and a choice may be made among a variety of insulating materials. For example, titanium oxide-base compound oxides, titanate-base compound oxides, and mixtures thereof are preferred.

Examples of the titanium oxide-base compound oxides include titanium oxide ($TiO_2$) which optionally contains nickel oxide (NiO), copper oxide (CuO), manganese oxide ($Mn_3O_4$), alumina ($Al_2O_3$), magnesium oxide (MgO), silicon oxide ($SiO_2$), etc. in a total amount of 0.001 to 30% by weight. An exemplary titanate-base compound oxide is barium titanate ($BaTiO_3$), which may have a Ba/Ti atomic ratio between about 0.95 and about 1.20.

The titanate-base compound oxide ($BaTiO_3$) may contain one or more oxides selected from magnesium oxide (MgO), manganese oxide ($Mn_3O_4$), tungsten oxide ($WO_3$), calcium oxide (CaO), zirconium oxide ($ZrO_2$), niobium oxide ($Nb_2O_5$), cobalt oxide ($Co_3O_4$), yttrium oxide ($Y_2O_3$), and barium oxide (BaO) in a total amount of 0.001 to 30% by weight. Also, at least one oxide selected from among $SiO_2$, MO (wherein M is one or more elements selected from Mg, Ca, Sr and Ba), $Li_2O$ and $B_2O_3$ may be included as an auxiliary component for adjusting the firing temperature and coefficient of linear expansion. The insulator layer generally has a thickness of about 5 to 1,000 $\mu$m, preferably about 5 to 50 $\mu$m, and more preferably about 10 to 50 $\mu$m, though the thickness is not critical.

The insulator layer may also be formed of a dielectric material. Use of dielectric material is preferred particularly when the composite substrate is applied to thin-film EL devices. The dielectric material used is not critical and selected from a variety of dielectric materials, for example, titanium oxide-base compound oxides, titanate-base compound oxides, and mixtures thereof as described above.

The titanium oxide-base compound oxides are the same as above. Also, at least one oxide selected from among $SiO_2$, MO (wherein M is one or more elements selected from Mg, Ca, Sr and Ba), $Li_2O$ and $B_2O_3$ may be included as an auxiliary component for adjusting the firing temperature and coefficient of linear expansion.

Especially preferred dielectric materials are given below. These dielectric materials contain barium titanate as a main component and silicon oxide and at least one of magnesium oxide, manganese oxide, barium oxide and calcium oxide as auxiliary components of the dielectric layer (or insulating layer). On calculating barium titanate as $BaTiO_3$, magnesium oxide as MgO, manganese oxide as MnO, barium oxide as BaO, calcium oxide as CaO and silicon oxide as $SiO_2$, the proportions of the respective compounds in the dielectric layer are MgO: 0.1 to 3 mol, preferably 0.5 to 1.5 mol, MnO: 0.05 to 1.0 mol, preferably 0.2 to 0.4 mol, BaO+CaO: 2 to 12 mol, and $SiO_2$: 2 to 12 mol per 100 mol of $BaTiO_3$.

The ratio $(BaO+CaO)/SiO_2$ is not critical although it is preferably between 0.9 and 1.1. BaO, CaO and $SiO_2$ may be incorporated in the form of $(Ba_xCa_{1-x}O)_y.SiO_2$. Herein, x and y preferably satisfy $0.3 \leqq x \leqq 0.7$ and $0.95 \leqq y \leqq 1.05$ in order to obtain a dense sintered body. The content of $(Ba_xCa_{1-x}O)_y.SiO_2$ is preferably 1 to 10% by weight, and more preferably 4 to 6% by weight based on the total weight of $BaTiO_3$, MgO and MnO. It is noted that the oxidized state of each oxide is not critical as long as the contents of metal elements constituting the respective oxides are within the above ranges.

Preferably, the dielectric layer contains up to 1 mol calculated as $Y_2O_3$ of yttrium oxide as an auxiliary component per 100 mol calculated as $BaTiO_3$ of barium titanate. The lower limit of the $Y_2O_3$ content is not critical although inclusion of at least 0.1 mol is preferred to achieve a satisfactory effect. When yttrium oxide is included, the content of $(Ba_xCa_{1-x}O)_y.SiO_2$ is preferably 1 to 10% by weight, and more preferably 4 to 6% by weight based on the total weight of $BaTiO_3$, MgO, MnO and $Y_2O_3$.

The reason of limitation of the respective auxiliary components is given below.

If the content of magnesium oxide is below the range, the temperature response of capacitance does not fall within the desired range. A content of magnesium oxide above the range abruptly exacerbates sintering, resulting in insufficient consolidation, a short IR accelerated lifetime and a low relative permittivity.

If the content of manganese oxide is below the range, satisfactory reduction resistance is lost, resulting in an insufficient IR accelerated lifetime. It also becomes difficult to reduce the dielectric loss tan δ. A content of manganese oxide above the range makes it difficult to reduce the change with time of capacitance under a DC electric field applied.

If the contents of BaO+CaO, $SiO_2$ and $(Ba_xCa_{1-x}O)_y.SiO_2$ are too low, the change with time of capacitance under a DC electric field applied becomes large and the IR accelerated lifetime becomes insufficient. If their contents are too high, an abrupt decline of relative permittivity appears.

Yttrium oxide is effective for improving the IR accelerated lifetime. With a content of yttrium oxide above the range, the layer may have a reduced capacitance and be insufficiently consolidated due to ineffective sintering.

Further, aluminum oxide may be contained in the insulator layer. Aluminum oxide has the function of enabling sintering at relatively low temperatures. The content of aluminum oxide calculated as $Al_2O_3$ is preferably 1% by weight or less based on the entire dielectric material. Too high an aluminum oxide content raises a problem that sintering is rather retarded.

Preferably the insulator layer has a thickness of up to about 100 μm, more preferably up to about 50 μm, and especially about 2 to 20 μm, per layer. A thickness of up to 300 μm is preferred because too thick an insulator layer can have a reduced capacitance so that only a reduced voltage may be applied across the light emitting layer, cause image blur owing to spreading of an internal electric field when a display is constructed therefrom, and permit cross-talks to occur.

An organic binder may be used when a paste for forming the insulator layer is prepared. The organic binder used herein is the same as described for the substrate. Among these, thermoplastic resins, especially acrylic and butyral resins are preferred. In the insulating layer-forming paste, various additives such as dispersants, plasticizers, and insulators are contained if necessary. The overall content of these additives should preferably be no more than 1 wt %.

The composite substrate is obtained in this way.

From the composite substrate of the invention, an EL device can be fabricated by forming thereon functional films including a light emitting layer, another insulating layer, and another electrode layer. In particular, an EL device having improved performance can be obtained using a dielectric material in the insulating layer of the composite substrate according to the invention. Since the composite substrate of the invention is a sintered material, it is also suited for use in an EL device which is fabricated by carrying out heat treatment subsequent to the formation of a functional film or light emitting layer.

To fabricate an EL device using the composite substrate of the invention, a light emitting layer, another insulating layer or dielectric layer, and another electrode layer may be formed on the insulating layer or dielectric layer in the described order.

Exemplary materials for the light emitting layer include the materials described in monthly magazine Display, April 1998, Tanaka, "Technical Trend of Recent Displays," pp. 1–10. Illustrative are ZnS and Mn/CdSSe as the red light emitting material, ZnS:TbOF and ZnS:Tb as the green light emitting material, and SrS:Ce, (SrS:Ce/ZnS)n, $Ca_2Ga_2S_4$:Ce, and $Sr_2Ga_2S_4$:Ce as the blue light emitting material.

SrS:Ce/ZnS:Mn or the like is known as the material capable of emitting white light.

Among the foregoing materials, better results are obtained when the invention is applied to the EL device having a blue light emitting layer of SrS:Ce studied in International Display Workshop (IDW), '97, X. Wu, "Multicolor Thin-Film Ceramic Hybrid EL Displays," pp. 593–596.

The thickness of the light emitting layer is not critical. However, too thick a layer requires an increased drive voltage whereas too thin a layer results in a low emission efficiency. Illustratively, the light emitting layer is preferably about 100 to 1,000 nm thick, and preferably about 150 to 500 nm thick, although the thickness varies depending on the identity of the fluorescent material.

In forming the light emitting layer, any vapor phase deposition technique may be used. The preferred vapor phase deposition techniques include physical vapor deposition such as sputtering or evaporation, and chemical vapor deposition (CVD). Of these, the chemical vapor deposition (CVD) technique is preferred.

Also, as described in the above-referred IDW, when a light emitting layer of SrS:Ce is formed in a $H_2S$ atmosphere by an electron beam evaporation technique, the resulting light emitting layer can be of high purity.

Following the formation of the light emitting layer, heat treatment is preferably carried out. Heat treatment may be carried out after an electrode layer, an insulating layer, and a light emitting layer are sequentially deposited in order from the substrate side. Alternatively, heat treatment (cap annealing) may be carried out after an electrode layer, an insulating layer, a light emitting layer and an insulating layer are sequentially deposited in order from the substrate side or after an electrode layer is further formed thereon. Often, cap annealing is preferred. The temperature of heat treatment is preferably about 600 to the substrate sintering temperature, more preferably about 600 to 1300° C., especially about 800 to 1200° C., and the time is about 10 to 600 minutes, especially about 30 to 180 minutes. The atmosphere during the annealing treatment may be $N_2$, Ar, He, or $N_2$ in admixture with up to 0.1% of $O_2$.

The insulating layer formed on the light emitting layer preferably has a resistivity of at least about $10^8$ Ω·cm, especially about $10^{10}$ to $10^{18}$ Ω·cm. A material having a relatively high permittivity as well is preferred. Its permittivity ε is preferably about 3 to 1,000.

The materials of which the insulating layer is made include, for example, silicon oxide ($SiO_2$), silicon nitride (SiN), tantalum oxide ($Ta_2O_5$), strontium titanate ($SrTiO_3$), yttrium oxide ($Y_2O_3$), barium titanate ($BaTiO_3$), lead titanate ($PbTiO_3$), zirconia ($ZrO_2$), silicon oxynitride (SiON), alumina ($Al_2O_3$), lead niobate ($PbNb_2O_6$), etc.

The technique of forming the insulating layer from these materials is the same as described for the light emitting layer. The insulating layer preferably has a thickness of about 50 to 1,000 nm, especially about 100 to 500 nm.

The EL device of the invention is not limited to the single light emitting layer construction. For example, a plurality of light emitting layers may be stacked in the thickness direction, or a plurality of light emitting layers (pixels) of different type are combined in a planar arrangement so as to define a matrix pattern.

Since the EL device of the invention uses the substrate material resulting from firing, even a light emitting layer capable of emitting blue light at a high luminance is readily available. Additionally, since the surface of the insulating layer on which the light emitting layer lies is smooth and flat, a color display featuring high performance and fine definition can be constructed. The manufacturing process is relatively easy and the manufacturing cost can be kept low. Because of its efficient emission of blue light at a high luminance, the device can be combined as a white light emitting device with a color filter.

As the color filter film, any of color filters used in liquid crystal displays or the like may be employed. The characteristics of a color filter are adjusted to match with the light emitted by the EL device, thereby optimizing extraction efficiency and color purity.

It is also preferred to use a color filter capable of cutting external light of short wavelength which is otherwise absorbed by the EL device materials and fluorescence conversion layer, because the light durability and display contrast of the device are improved.

An optical thin film such as a dielectric multilayer film may be used instead of the color filter.

The fluorescence conversion filter film is to convert the color of light emission by absorbing electroluminescence and allowing the phosphor in the film to emit light. It is formed from three components: a binder, a fluorescent material, and a light absorbing material.

The fluorescent material used may basically have a high fluorescent quantum yield and desirably exhibits strong absorption in the electroluminescent wavelength region. In practice, laser dyes are appropriate. Use may be made of rhodamine compounds, perylene compounds, cyanine compounds, phthalocyanine compounds (including subphthalocyanines), naphthalimide compounds, fused ring hydrocarbon compounds, fused heterocyclic compounds, styryl compounds, and coumarin compounds.

The binder is selected from materials which do not cause extinction of fluorescence, preferably those materials which can be finely patterned by photolithography or printing technique.

The light absorbing material is used when the light absorption of the fluorescent material is short and may be omitted if unnecessary. The light absorbing material may also be selected from materials which do not cause extinction of fluorescence of the fluorescent material.

The EL device of the invention is generally operated by pulse or AC drive. The applied voltage is generally about 50 to 300 volts.

Although the EL device has been described as a representative application of the composite substrate, the application of the composite substrate of the invention is not limited thereto. It is applicable to a variety of electronic materials, for example, thin-film/thick-film hybrid high-frequency coil elements.

EXAMPLE

Examples are given below. The EL structure used in the Examples is constructed such that a light emitting layer, an upper insulating layer and an upper electrode were successively deposited on the surface of an insulating layer of a composite substrate by thin-film techniques.

Example 1

A paste, which was prepared by mixing Ag-Ti powder with a binder (ethyl cellulose) and a solvent (terpineol), was printed on a substrate of 99.5% $Al_2O_3$ in a stripe pattern including stripes of 1.5 mm wide and gaps of 1.5 mm, and dried at 110° C. for several minutes. A dielectric paste was prepared by mixing $Pb(Mg_{1/3}Nb_{2/3})O_3$—$PbTiO_3$ (PMN—PT) powder raw material having a mean particle size of 1 $\mu$m with a binder (acrylic resin) and a solvent.

The dielectric paste was printed on the substrate having the electrode pattern printed thereon and dried, and the printing and drying steps were repeated ten times. The resulting green dielectric layer had a thickness of about 80 $\mu$m. Then, the entire structure was subjected to compression for 10 minutes under a pressure of 500 ton/m$^2$. Finally, the structure was fired in air at 900° C. for 30 minutes. The thick-film dielectric layer as fired had a thickness of 55 $\mu$m.

Example 2

In Example 1, the electrode and dielectric pastes were prepared using a thermoplastic acrylic resin as the binder, and the precursor was heated at a temperature of 120° C. during the compression. Otherwise as in Example 1, a composite substrate was obtained.

Example 3

In Example 2, a PET film coated with a parting agent (silicone) was interposed between the die and the green dielectric layer during the compression. Otherwise as in Example 1, a composite substrate was obtained.

In each of Examples, the surface roughness of the dielectric layer was measured by means of a Talistep while moving a probe at a speed of 0.1 mm/sec over 0.8 mm. Also, to measure the electrical properties of the dielectric layer, an upper electrode was formed thereon. The upper electrode was formed by printing the above electrode paste to a stripe pattern having a width of 1.5 mm and a gap of 1.5 mm so as to extend perpendicular to the underlying electrode pattern on the substrate, drying and firing at 850° C. for 15 minutes.

Dielectric properties were measured at a frequency of 1 kHz using an LCR meter. Insulation resistance was determined by measuring a current flow after applying a voltage of 25 V for 15 seconds and holding for one minute. Breakdown voltage was the voltage value at which a current of at least 0.1 mA flowed when the voltage applied across the sample was increased at a rate of 100 V/sec. Measurement of surface roughness and electrical properties was made at three distinct positions on a single sample and an average thereof was reported as a measurement.

The composite substrate of Example 3 had electrical properties, a permittivity of 19,300, tan $\delta$ of 2.0%, a resistivity of $8\times10^{11}$ $\Omega$–cm, and a breakdown voltage of 14 V/$\mu$m.

On the composite substrate not having an upper electrode, which was heated at 250° C., a ZnS phosphor thin film was deposited to a thickness of 0.7 $\mu$m by a sputtering technique using a Mn-doped ZnS target. This was heat treated in vacuum at 600° C. for 10 minutes. Thereafter, a $Si_3N_4$ thin film as the second insulating layer and an ITO thin film as the second electrode were successively formed by a sputtering technique, completing an EL device. Light emission was measured by extending electrodes from the print fired electrode and ITO transparent electrode in the resulting device structure and applying an electric field at a frequency of 1 kHz and a pulse width of 50 $\mu$s.

The results are shown in Table 1.

TABLE 1

| | | Surface roughness (unit: μm) | | | | | | | | Light emission | |
|---|---|---|---|---|---|---|---|---|---|---|---|
| | | Before firing | | | | After firing | | | | When EL device | |
| | Compression | Ra | RMS | Rmax | Rz | Ra | RMS | Rmax | Rz | constructed | Remarks |
| Com.1 | No | 0.500 | 0.637 | 7.945 | 4.359 | 0.778 | 1.096 | 10.685 | 6.939 | not emitted | |
| Ex.1 | Yes | 0.252 | 0.287 | 3.501 | 1.989 | 0.352 | 0.528 | 4.628 | 3.249 | light emitted | |
| Ex.2 | Yes | 0.198 | 0.222 | 2.851 | 1.502 | 0.287 | 0.452 | 3.925 | 2.998 | light emitted | |
| Ex.3 | Yes | 0.073 | 0.099 | 1.097 | 0.635 | 0.187 | 0.240 | 2.287 | 1.671 | light emitted | |

Com.: Comparative Example
Ex.: Example

BENEFITS OF THE INVENTION

According to the invention, there are provided a method for preparing a composite substrate, which prevents an insulating layer surface from becoming rugged under the influence of an electrode layer, and eliminates a polishing step, whereby the composite substrate is easy to manufacture and ensures high display quality when applied to thin-film light emitting devices, the composite substrate and an EL device using the same.

What is claimed is:

1. A method for preparing an EL device including a composite substrate, comprising the steps of:

successively applying an electrode paste and an insulator paste onto an electrically insulating substrate as thick films to form a composite substrate precursor having a green electrode layer and a green insulator layer;

subjecting the composite substrate precursor to a pressing treatment using a die press or roll, for smoothing a surface of the green insulator layer to have a surface roughness Ra of up to 0.1 μm; and firing to complete the composite substrate.

2. The method according to claim 1, wherein during the pressing treatment, the die or roll used for pressing is held at a temperature in the range of 50 to 200° C.

3. The method according to claim 1, wherein at least one of said electrode paste and said insulator paste uses a thermoplastic resin as a binder.

4. The method according to claim 1, wherein during the pressing treatment, a resin film having a parting agent thereon is interposed between the die or roll and the green insulating layer.

* * * * *

UNITED STATES PATENT AND TRADEMARK OFFICE

CERTIFICATE OF CORRECTION

PATENT NO. : 6,709,695 B2
DATED : March 23, 2004
INVENTOR(S) : Takeishi et al.

It is certified that error appears in the above-identified patent and that said Letters Patent is hereby corrected as shown below:

Title page,
Item [75], Inventors, should read:
-- [75] Inventors: Taku Takeishi, Tokyo, (JP); Katsuto Nagano, Tokyo (JP); Suguru Takayama, Tokyo (JP) --

Signed and Sealed this

Twenty-fourth Day of May, 2005

JON W. DUDAS
*Director of the United States Patent and Trademark Office*